US007578583B2

(12) United States Patent
Chou et al.

(10) Patent No.: US 7,578,583 B2
(45) Date of Patent: Aug. 25, 2009

(54) FLUID INJECTION DEVICES WITH SENSORS, FLUID INJECTION SYSTEM AND METHOD OF ANALYZING FLUID IN FLUID INJECTION DEVICES

(75) Inventors: Chung-Cheng Chou, Taoyuan County (TW); Chih-Ming Lin, Taichung (TW)

(73) Assignee: Qisda Corporation, Taoyuan County (TW)

( * ) Notice: Subject to any disclaimer, the term of this patent is extended or adjusted under 35 U.S.C. 154(b) by 555 days.

(21) Appl. No.: 11/505,796

(22) Filed: Aug. 16, 2006

(65) Prior Publication Data

US 2007/0040860 A1 Feb. 22, 2007

(30) Foreign Application Priority Data

Aug. 17, 2005 (TW) ..... 94128022 A

(51) Int. Cl.
*B41J 2/05* (2006.01)
*B41J 29/393* (2006.01)

(52) U.S. Cl. ..... 347/56; 347/19

(58) Field of Classification Search ..... 347/7, 347/19, 54, 56

See application file for complete search history.

(56) References Cited

U.S. PATENT DOCUMENTS

| | | | | |
|---|---|---|---|---|
| 4,275,290 | A * | 6/1981 | Cielo et al. | 347/61 |
| 5,699,090 | A | 12/1997 | Wade et al. | |
| 6,702,894 | B2 * | 3/2004 | Lee et al. | 118/325 |
| 7,172,267 | B2 * | 2/2007 | Furukawa | 347/55 |
| 7,328,982 | B2 * | 2/2008 | Kusakari | 347/68 |

* cited by examiner

*Primary Examiner*—Anh T. N. Vo

(57) ABSTRACT

A fluid injection device integrating a piezoelectric sensor, a fluid injection apparatus and a method for analyzing fluid content in a fluid injection device. The fluid injection device comprises a fluid injector and a piezoelectric sensor. The fluid injector comprises a plurality of fluid chambers formed in a substrate for receiving fluid. A structural layer is disposed on the substrate and the plurality of fluid chambers. At least one fluid actuator is disposed on the structural layer opposing each fluid chamber. A nozzle is adjacent to the at least one fluid actuator and connecting each fluid chamber through the structural layer. The piezoelectric sensor id disposed on the structural layer to analyze fluid content in each fluid chamber.

20 Claims, 12 Drawing Sheets

FLUID INJECTION DEVICES WITH SENSORS, FLUID INJECTION SYSTEM AND METHOD OF ANALYZING FLUID IN FLUID INJECTION DEVICES

BACKGROUND

The invention relates to fluid injection devices, and more particularly, to fluid injection devices integrating piezoelectric sensors and methods of analyzing fluid in fluid injection devices.

Fluid injection devices have been applied in information technology industries for decades. As micro-system engineering technologies have progressed, fluid injection devices have typically been employed in inkjet printers, fuel injection systems, cell sorting systems, drug delivery systems, print lithography systems and micro-jet propulsion systems. Among inkjet printers presently known and used, fluid injection devices can be divided into two categories continuous mode and drop-on-demand mode, depending on the fluid injection device.

According to the driving mechanism, conventional fluid injection devices can further be divided into thermal bubble driven and piezoelectric diaphragm driven fluid injection devices. Of the two, injection by thermally driven bubbles has been most successful due to its reliability, simplicity and relatively low cost. No matter which kind of injection device is selected, in situ analysis of ink in a fluid injection device is an important issue in replacing an ink cartridge. If the amount of ink in the fluid injection device is inadequate, not only does print quality deteriorate, but, the fluid injection device itself, such as a heater, can also be damaged due to a dry firing effect.

U.S. Pat. No. 5,699,090, the entirety of which is hereby incorporated by reference, discloses a thermal bubble driven ink jet printhead. By measuring the average in resistance dependent on temperature change, the amount of ink in an inkjet printhead can be estimated.

FIG. 1 is a block diagram of methods for optimizing printing parameters for a conventional inkjet printhead. After a controller 111 receives and processes printing data, operating signals are transmitted to a printhead driver circuit 113. A voltage control power supply 115 provides a control voltage $V_S$ to the printhead driver circuit 113. The magnitude of the control voltage $V_S$ is controlled by the voltage control power supply 115. The printhead driver circuit 113 controlled by the controller 111 provides a driving voltage pulse $V_P$ to heaters 117 of the thermally driven inkjet printhead 119, thereby triggering inkjet injection. Subsequently, a temperature sensing resistor 123 on the inkjet printhead 119 can be provided as reference for each heater 117 of the thermally driven inkjet printhead 119. An analog signal is output to analog/digital (A/D) converter 125 according to the comparison between temperature sensing resistor 123 and each heater 117, thereby optimizing printing parameters for the thermal bubble driven inkjet printhead.

FIG. 2 sets forth a representative graph of normalized printhead temperature plotted against time. The graph of FIG. 2 indicates different phases of operation of the heater resistors of a printhead. The control circuit for the inkjet printhead can depend on the graph of FIG. 2 to optimize printing parameters. The graph of FIG. 2, however, can be affected by materials of the temperature sensing resistor, circuit layout, and positions of the temperature sensing resistor. Current passing through the temperature sensing resistor may cause increased temperature, affecting accuracy of the graph of FIG. 2. Measurement of ink content in the inkjet printhead using the temperature sensing resistor 123 is intrinsically limited and not applicable to non-thermally driven injection devices.

SUMMARY

A fluid injection device integrating a piezoelectric sensor is provided. The piezoelectric sensor can promptly measure resonating frequencies of a structural layer at which fluid content is insufficient. By employing a fluid injection device integrating a piezoelectric sensor, a cartridge can be immediately replaced as soon as the amount of fluid in the chamber is insufficient.

The invention provides a fluid injection device integrating a piezoelectric sensor comprising a fluid injector and a piezoelectric sensor. The fluid injector comprises a plurality of fluid chambers formed in a substrate for receiving fluid. A structural layer is disposed on the substrate and the plurality of fluid chambers. At least one fluid actuator is disposed on the structural layer opposing each fluid chamber. A nozzle is adjacent to the at least one fluid actuator and connects each fluid chamber through the structural layer. The piezoelectric sensor is disposed on the structural layer to analyze fluid content in each fluid chamber.

The invention also provides a fluid injection apparatus comprising a cartridge, a fluid injector chip with a plurality of fluid injectors disposed on the cartridge, and at least one piezoelectric sensor. Each fluid injector comprises a plurality of fluid chambers formed in a substrate connecting the cartridge. A structural layer is disposed on the substrate and the plurality of fluid chambers. At least one fluid actuator is disposed on the structural layer opposing each fluid chamber. A nozzle adjacent to the at least one fluid actuator connects each fluid chamber through the structural layer. The piezoelectric sensor is disposed on the structural layer to analyze fluid content in each fluid chamber.

The invention further provides a method for analyzing fluid content in a fluid injection device. The fluid injection device has a fluid chamber with a structural layer thereon and at least one actuator disposed on the structural layer. The method comprises measuring a resonant frequency of the structural layer with a piezoelectric sensor, thereby outputting a signal, and receiving the signal and optimizing printing parameters accordingly.

DESCRIPTION OF THE DRAWINGS

The invention can be more fully understood by reading the subsequent detailed description in conjunction with the examples and references made to the accompanying drawings, wherein.

DETAILED DESCRIPTION

Figure 1:
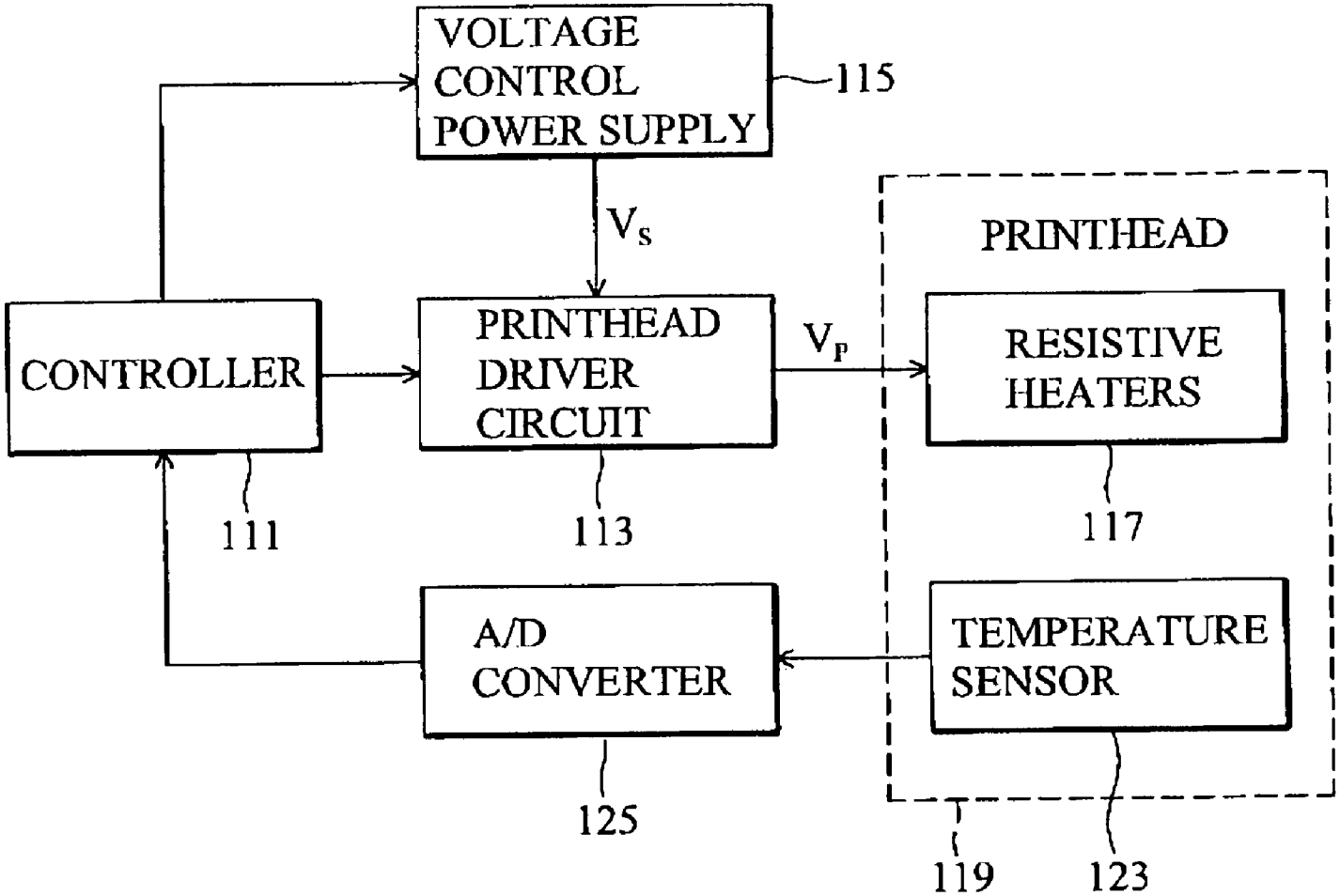
FIG. 1 ( RELATED ART )
FIG. 1 shows a block diagram of methods for optimizing printing parameters for a conventional inkjet printhead.
Figure 2:
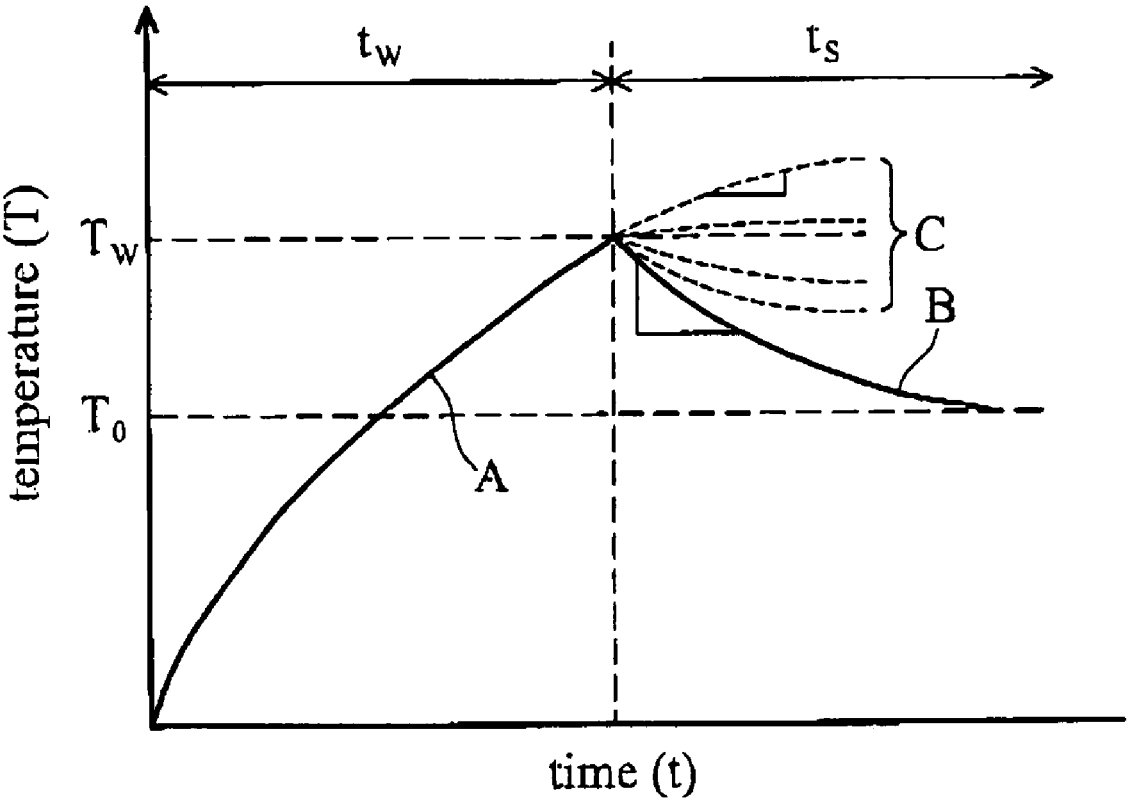
FIG. 2 ( RELATED ART )
FIG. 2 shows a representative graph of normalized printhead temperature plotted against time.
Figure 3A:
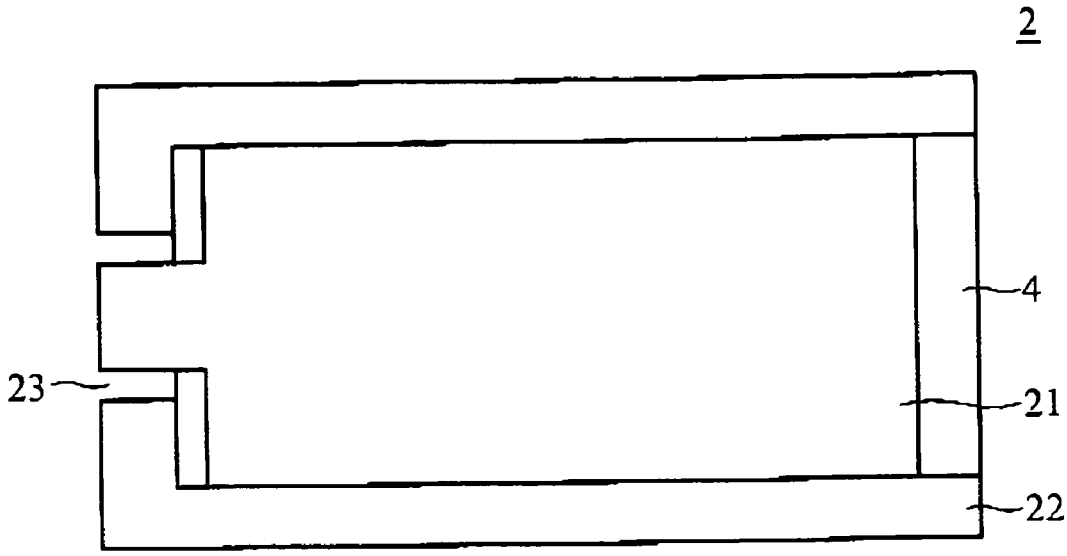
FIG. 3A shows a plan view of an embodiment of a piezoelectric sensor disposed on a fluid injection device.
Figure 3B:
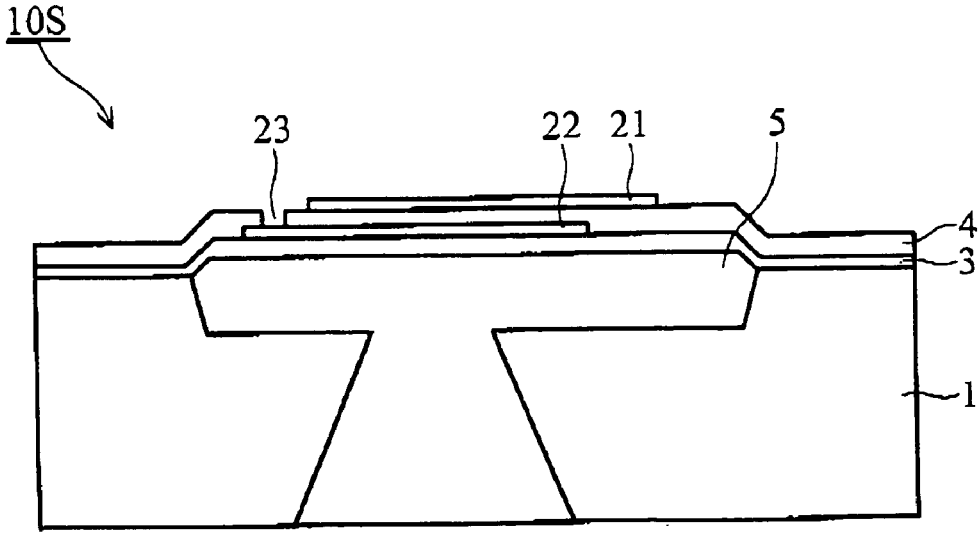
FIG. 3B shows a cross-section of an embodiment of a piezoelectric sensor disposed on a fluid injection device.
Figure 3C:
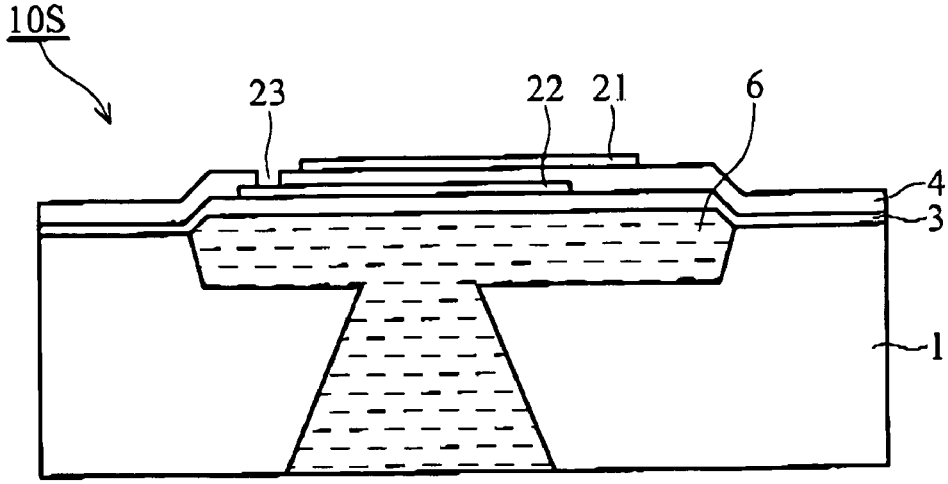
FIG. 3C shows a cross-section of an embodiment of a piezoelectric sensor disposed on a fluid injection device with fluid filled in a chamber.

FIG. 3A is a plan view of an embodiment of a piezoelectric sensor disposed on a fluid injection device. FIG. 3B is a cross-section of an embodiment of a piezoelectric sensor disposed on a fluid injection device. FIG. 3C is a cross-section of an embodiment of a piezoelectric sensor disposed on a fluid injection device with fluid filled in a chamber.

Referring to FIGS. 3A and 3B, a monolithic piezoelectric sensing unit 10S comprises a substrate 1 such as a single crystalline silicon substrate. A fluid chamber 5 is formed in the substrate 1. A structural layer 3 is disposed in the substrate 1 and the fluid chamber 5. The structural layer 3 is preferably a low stress layer, such as low stress $Si_3N_4$.

A first electrode 22, such as Au, Al, Pt, alloys, or a combination thereof, is formed on the structural layer 3. A piezoelectric layer 4 is formed on the first electrode 22. The piezoelectric layer 4 comprises ZnO, AlN, $LiNbO_3$, $LiTaO_3$, $PbTiO_3$, $(Ba_xSr_{1-x})TiO_3$, $Pb(Zr_yTi_{1-y})O_3$, or a combination thereof. A second electrode 21, such as Au, Al, Pt, alloys, or a combination thereof, is formed on the piezoelectric layer 4.

The first electrode 22, the piezoelectric layer 4, and the second electrode 21 are composed of a piezoelectric sensor 2. A via 23 in the piezoelectric layer 4 is created to measure piezoelectric signals. Since fluid content in the fluid chamber 5 is directly dependent on the elastic wave velocity in the piezoelectric layer 4, measuring the elastic wave velocity variation in the piezoelectric layer 4 can determine whether fluid is filled in the fluid chamber. An embodiment of the piezoelectric sensor is disclosed in detail in the following.

Figure 4:
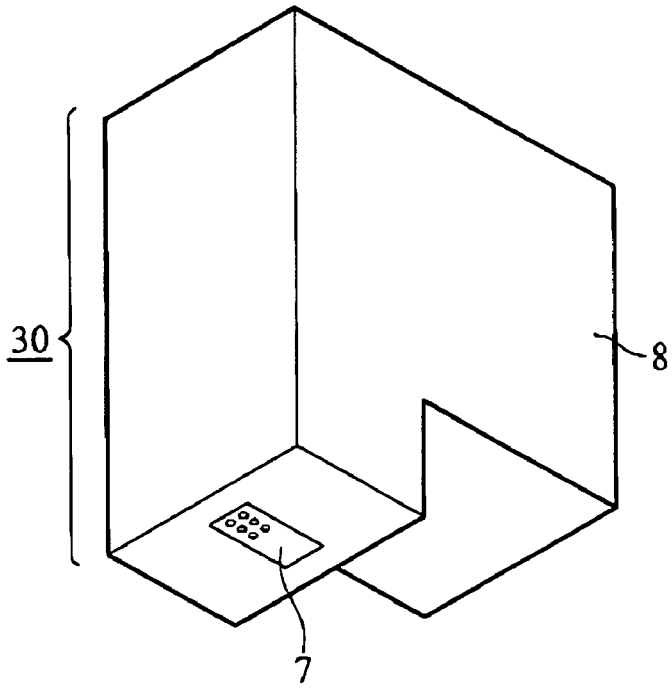
FIG. 4 shows a perspective view of an embodiment of a fluid injection device.

FIG. 4 is a perspective view of an embodiment of a fluid injection device. A fluid injection device 30 comprises a fluid injector chip 7 and ink cartridge 8.

Figure 5:
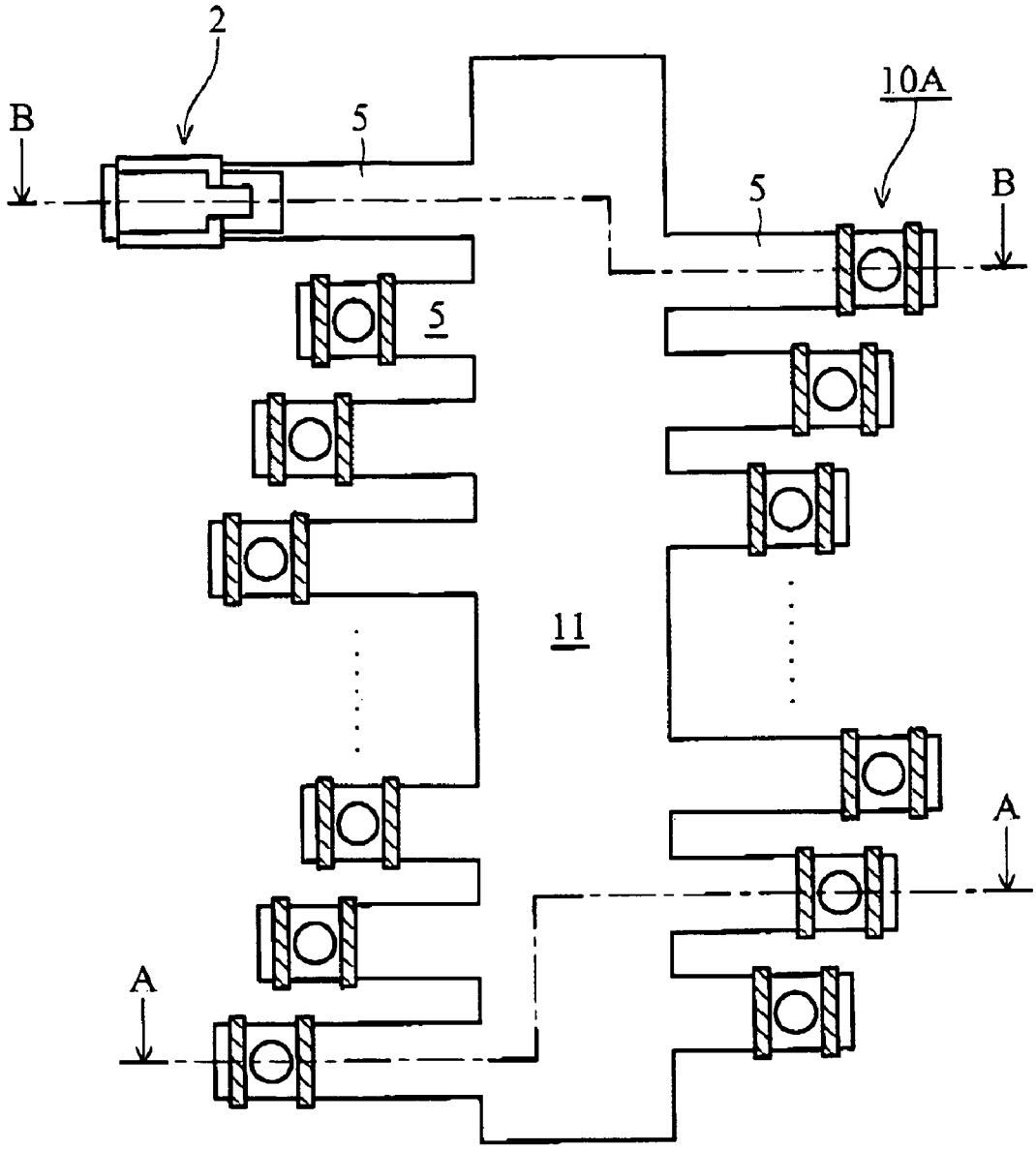
FIG. 5 shows a plan view of an embodiment of the fluid injector chip of FIG. 4.

FIG. 5 is a plan view of an embodiment of the fluid injector chip of FIG. 4. The fluid injector chip 7 comprises a plurality of injectors 10A. Fluid is provided from ink cartridge 8 via a filter, a stand pipe into a manifold 11 of the fluid injector chip 7. The fluid is subsequently filled into each fluid chamber 5 of injectors 10A for fluid injection. Each fluid chamber 5 is a different distance from the manifold 11 of the fluid injector chip 7.

Fluid injector chip 7 is a monolithic structure fabricated by a micro-electro-mechanical system (MEMS) process. For example, the fluid injector chip 7 is formed by lithographic and etching processes in a single crystalline silicon wafer. Piezoelectric sensor 2 is disposed on the fluid chamber farthest from the manifold 11.

Figure 6A:
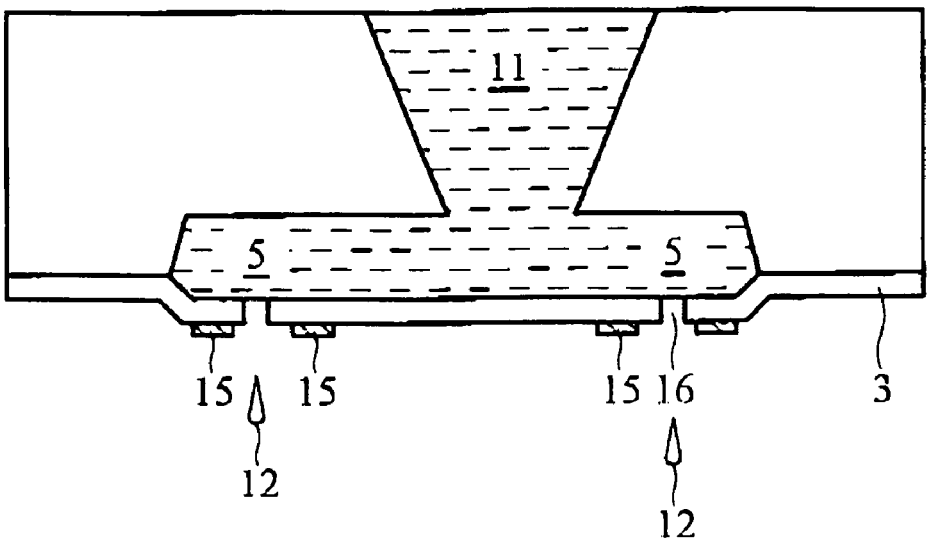
FIGS. 6A-6B show cross-sections taken along A-A of FIG. 5 showing a state of fluid filled in the fluid chamber.
Figure 6B:
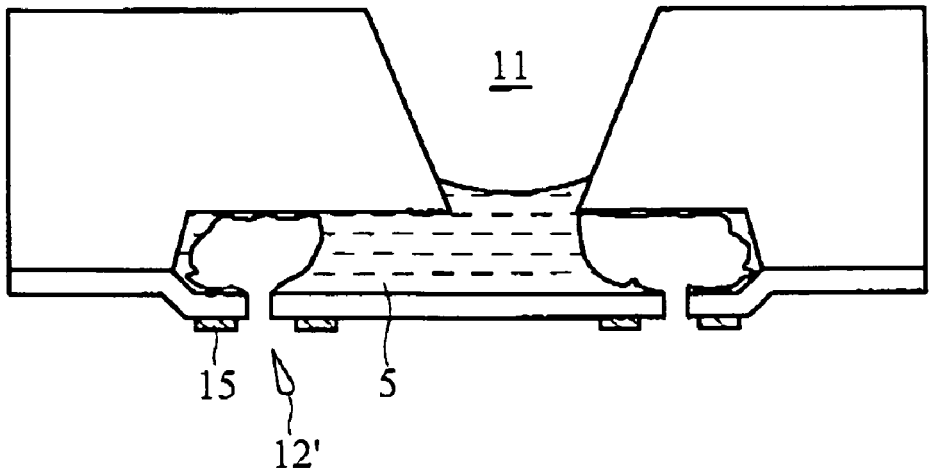

FIGS. 6A-6B are cross-sections taken along A-A of FIG. 5 showing a state of fluid in the fluid chamber. Referring to FIG. 6A, when the amount of fluid in the ink cartridge is sufficient, and the cartridge does not require refilling. Uniformity and trajectory of triggered droplets 12 are consistent. Referring to FIG. 6B, when the amount of fluid in the ink cartridge is insufficient, the chamber requires refilling. Uniformity and trajectory of triggered droplets 12' are inconsistent. Moreover, the fluid injector cannot be triggered, resulting in a dry-firing effect.

Figure 7A:
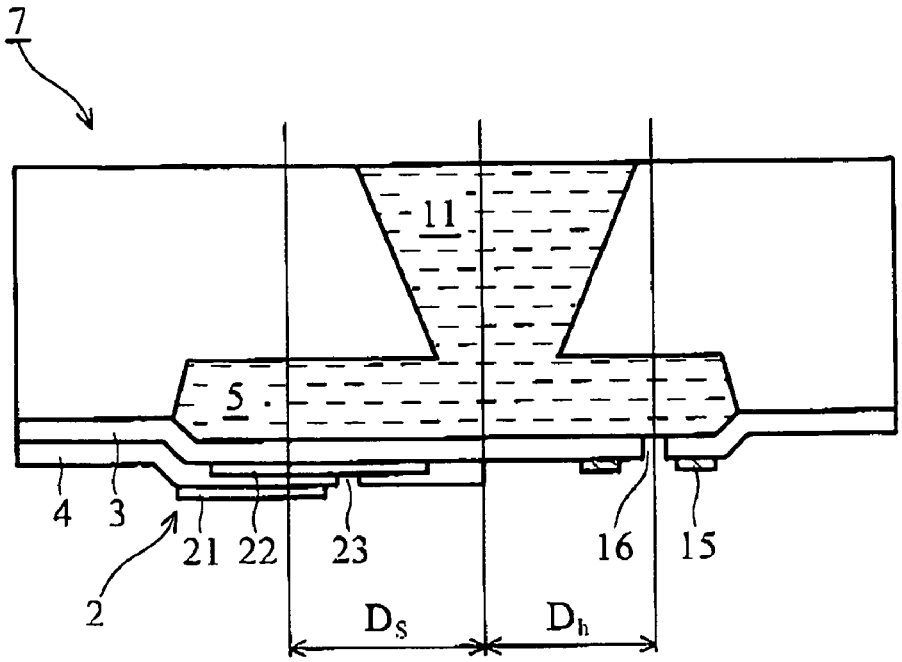
FIGS. 7A-7B show cross-sections taken along B-B of FIG. 5 showing a state of fluid filled in the fluid chamber with a piezoelectric sensor thereon.
Figure 7B:
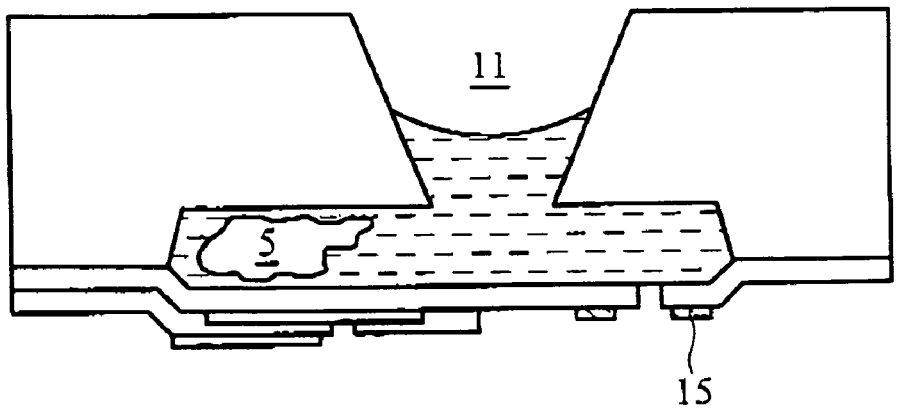

FIGS. 7A-7B are cross-sections taken along B-B of FIG. 5 showing a state of fluid filled in the fluid chamber with a piezoelectric sensor thereon. A piezoelectric sensor 2 comprising a lower electrode 22, a piezoelectric layer 4 and an upper electrode 21 is provided to measure the amount of fluid content in the fluid chamber.

The fluid injector chip 7 is fabricated by providing a single crystalline silicon substrate 1. A sacrificial layer (not shown), a structural layer 3, heaters 15 are sequentially formed on the silicon substrate 1. The silicon substrate 1 is then etched to create a manifold 11. The sacrificial layer (not shown) is removed to create a fluid chamber 5. A nozzle 16 is created by etching through the structural layer 3. If the heaters 15 are replaced by a piezoelectric sensor 2, a monolithic piezoelectric sensing unit 10S is provided.

The piezoelectric sensor 2 is fabricated by forming a lower electrode 22 on the structural layer 3. A piezoelectric layer 4 is deposited on the lower electrode 22. An upper electrode 21 is formed on the piezoelectric layer 4. An opening 13 is created in the piezoelectric layer 4 for measuring electric wave velocity in the piezoelectric layer 4.

Referring to FIG. 7A, a piezoelectric sensor 2 is disposed at the fluid chamber farthest from the center line of the manifold 11, i.e., $D_h<D_s$, where $D_h$ is the distance from the nozzle 16 of the fluid chamber farthest from the center line of the manifold 11, and $D_s$ is the distance from the piezoelectric sensor 2 to the center line of the manifold 11.

Referring to FIG. 7B, since the piezoelectric sensor 2 is disposed at the fluid chamber 5 farthest from the manifold 11, the fluid chamber 5 with an inadequate amount of ink under the piezoelectric sensor 2 will be refilled prior to other fluid chambers of the fluid injector chip. The piezoelectric sensor can serve as a thin film bulk acoustic resonator (FBAR), the resonant frequency of which is dependent on the velocity and wavelength of the acoustic wave:

$$f = \frac{v}{\gamma} = \frac{v}{2d} \qquad \text{Eq. 1}$$

where f is a resonant frequency of a piezoelectric sensor on an empty fluid chamber, v is longitudinal wave velocity of a piezoelectric layer on an empty fluid chamber, λ is the wavelength of the acoustic wave, and d is the thickness of the piezoelectric layer.

Figure 8A:
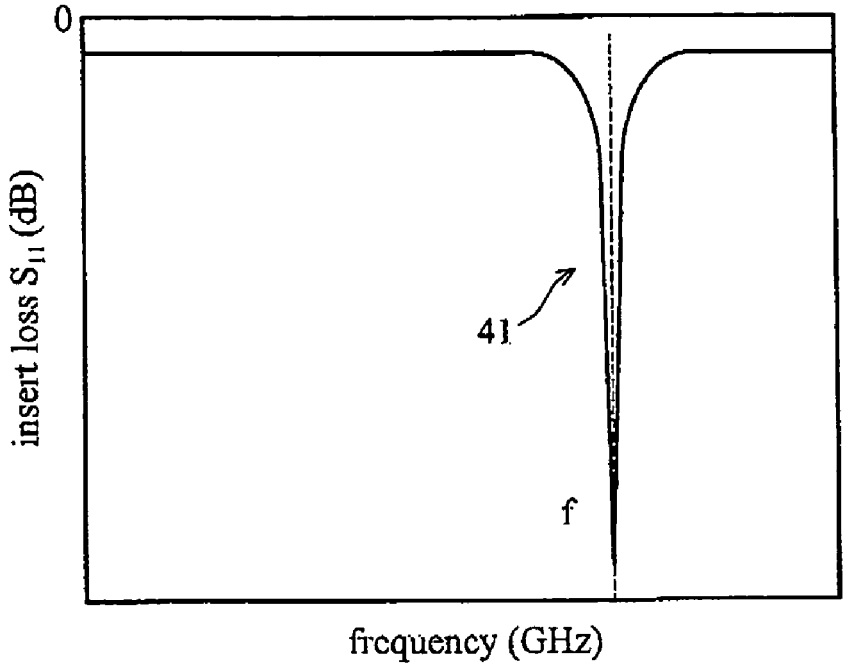
FIG. 8A show a graphical curve showing relationship between return loss $S_{11}$ and the resonant frequency of the piezoelectric sensor in an empty fluid chamber.

FIG. 8A is a graphical curve showing the relationship between the return loss $S_{11}$ and resonant frequency of the piezoelectric sensor on an empty fluid chamber. Indication 41 is the return loss $S_{11}$ when the fluid chamber is empty.

Since the oscillation of the piezoelectric layer is caused by longitudinal wave resonation, when the fluid chamber is refilled, mass loading on the piezoelectric layer may cause a damping effect. The longitudinal wave velocity is changed shifting the resonant frequency of the piezoelectric resonator and reducing the quality factor (Q factor). The shifted resonant frequency f' is represented as follows:

$$f' = \frac{v'}{\gamma} = \frac{v'}{2d} \quad \text{Eq. 2}$$

where f' is a resonant frequency of a piezoelectric sensor on a filled fluid chamber, v' is longitudinal wave velocity of a piezoelectric layer on a filled fluid chamber, λ is the wavelength of the acoustic wave, and d is the thickness of the piezoelectric layer.

Figure 8B:
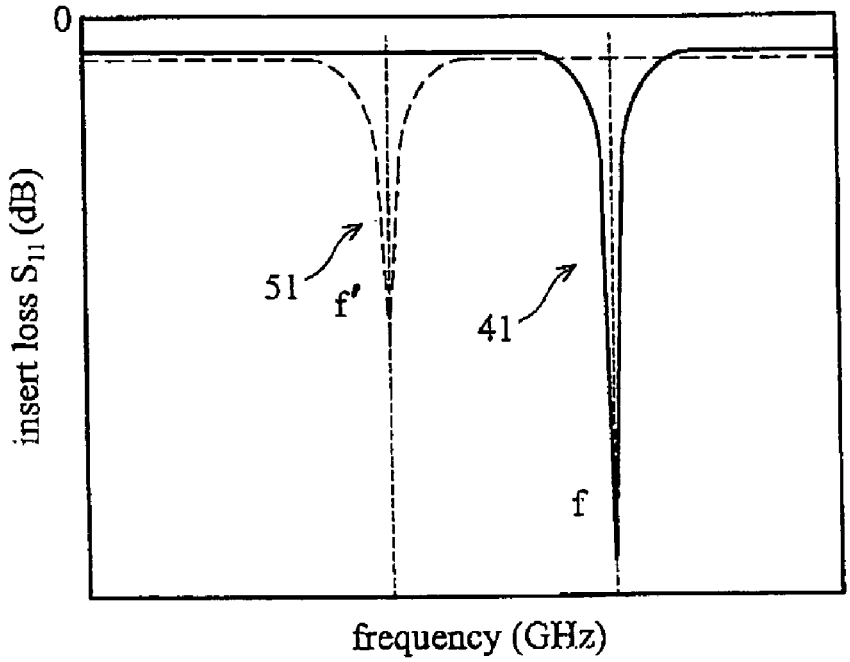
FIG. 8B shows a graphical curve showing relationship between return loss $S_{11}$ and the resonant frequency of the piezoelectric sensor in a filled fluid chamber.

FIG. 8B is a graphical curve showing the relationship between the return loss $S_{11}$ and resonant frequency of the piezoelectric sensor on a filled fluid chamber. Indication 51 is the return loss $S_{11}$ when the fluid chamber is empty. Therefore, whether a fluid chamber is filled can be ensured by measuring longitudinal wave velocity, resonating frequency, and quality factor of the piezoelectric sensor accordingly.

Figure 9:
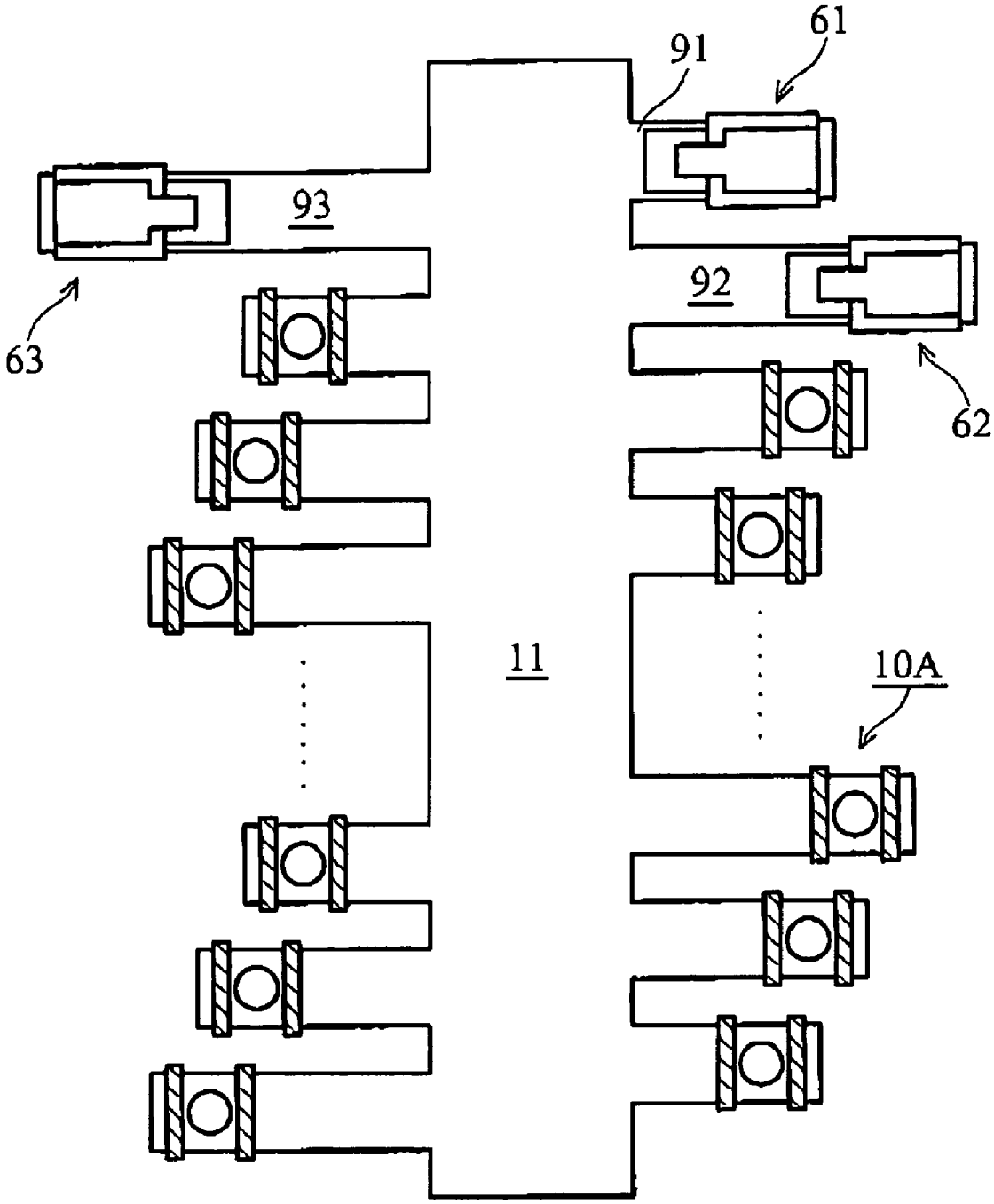
FIG. 9 shows a plan view of another embodiment of the fluid injector chip.

FIG. 9 is a plan view of another embodiment of the fluid injector chip. At least one piezoelectric sensor, such as three piezoelectric sensors 61, 62, and 63, are separately disposed overlying fluid chambers 91, 92, and 93 with various distances from the center line of the manifold 11. Fluid chamber 91 is the nearest to the manifold 11, while fluid chamber 92 is the farthest from the manifold 11. Fluid chamber 93 is a dummy chamber which is farther from the manifold 11 than the fluid chamber. When frequency variation is detected by piezoelectric sensor 63, the fluid in the cartridge is insufficient to refill each fluid chamber. Moreover, when frequency variation is detected by piezoelectric sensors 62 and 63, some of the fluid chambers have not been adequately refilled. Print quality is thus degraded and cartridge replacement is suggested. Moreover, when frequency variation is detected by piezoelectric sensors 61, 62 and 63, none of the fluid chambers have been adequately refilled and the cartridge must be promptly replaced. Signals measured by piezoelectric sensors 61, 62 and 63 are processed by feedback loop circuits, for example analog/digital converters, and transmitted to a controller. Nevertheless, the measuring sequences can be inverted from piezoelectric sensor 61 to piezoelectric sensor 63 to detect whether each fluid chamber is has been completely refilled.

Figure 10:
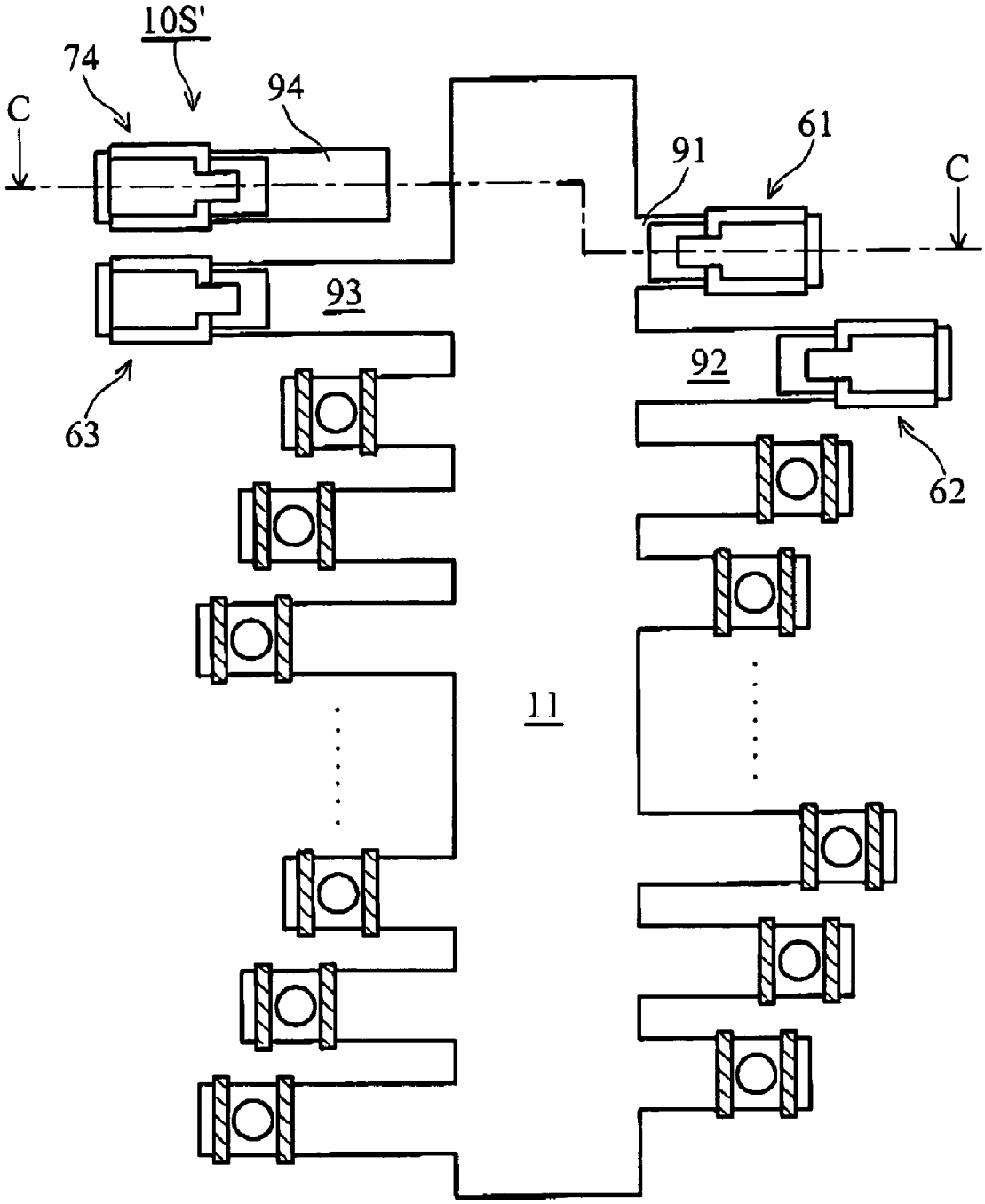
FIG. 10 shows a plan view of another embodiment of the fluid injector chip.
Figure 11:
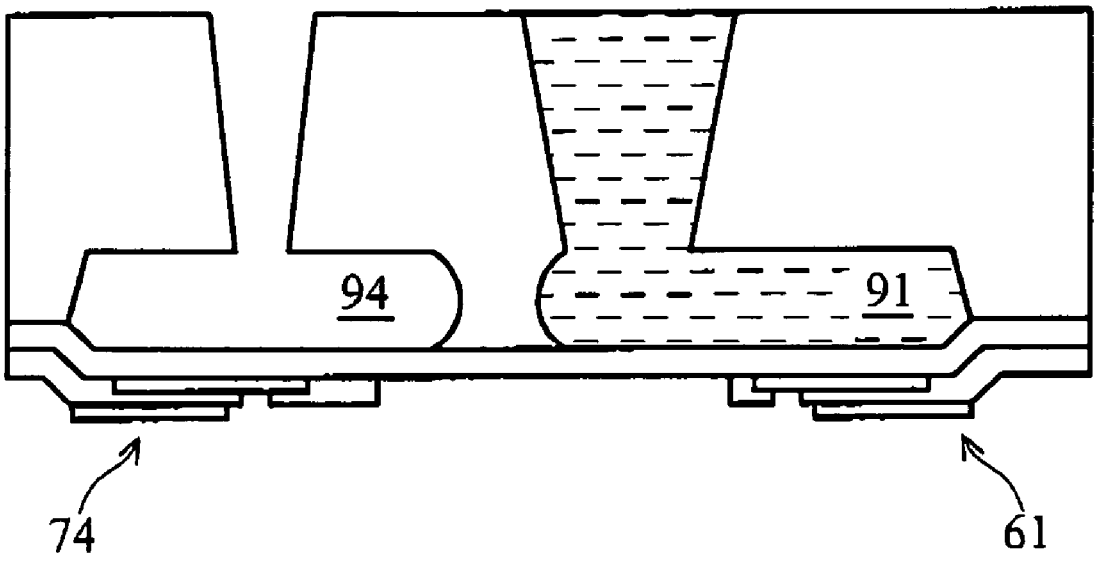
FIG. 11 shows a cross-section taken along C-C of FIG. 10 showing a state of fluid filled in the fluid chamber.

FIG. 10 is a plan view of another embodiment of the fluid injector chip. FIG. 11 is a cross-section taken along C-C of FIG. 10 showing a state of fluid filled in the fluid chamber. Referring to FIG. 10, a dummy piezoelectric sensor 10S' comprises a chamber 94 disconnected from the manifold 15. The distance from the dummy piezoelectric sensor 10S' to the manifold 11 equals or exceeds the distance from the fluid injector 93 farthest from the manifold 11. A piezoelectric sensor 74 is formed on the chamber 94. Note that since the chamber 94 is disconnected from the manifold 11, fluid does not fill the chamber 94 during operation. Therefore, the results measured by piezoelectric sensor 74 serve as reference for other piezoelectric sensors.

Accordingly, before the fluid injector chip is filled, each chamber is empty and the resonant frequencies measured by piezoelectric sensors 61, 62, 63, and 64 are the same. When the fluid injector chip is filled, the amount of fluid in each chamber can be estimated by comparing resonating frequencies measured by each piezoelectric sensor 61, 62, 63, and 64.

Figure 12:
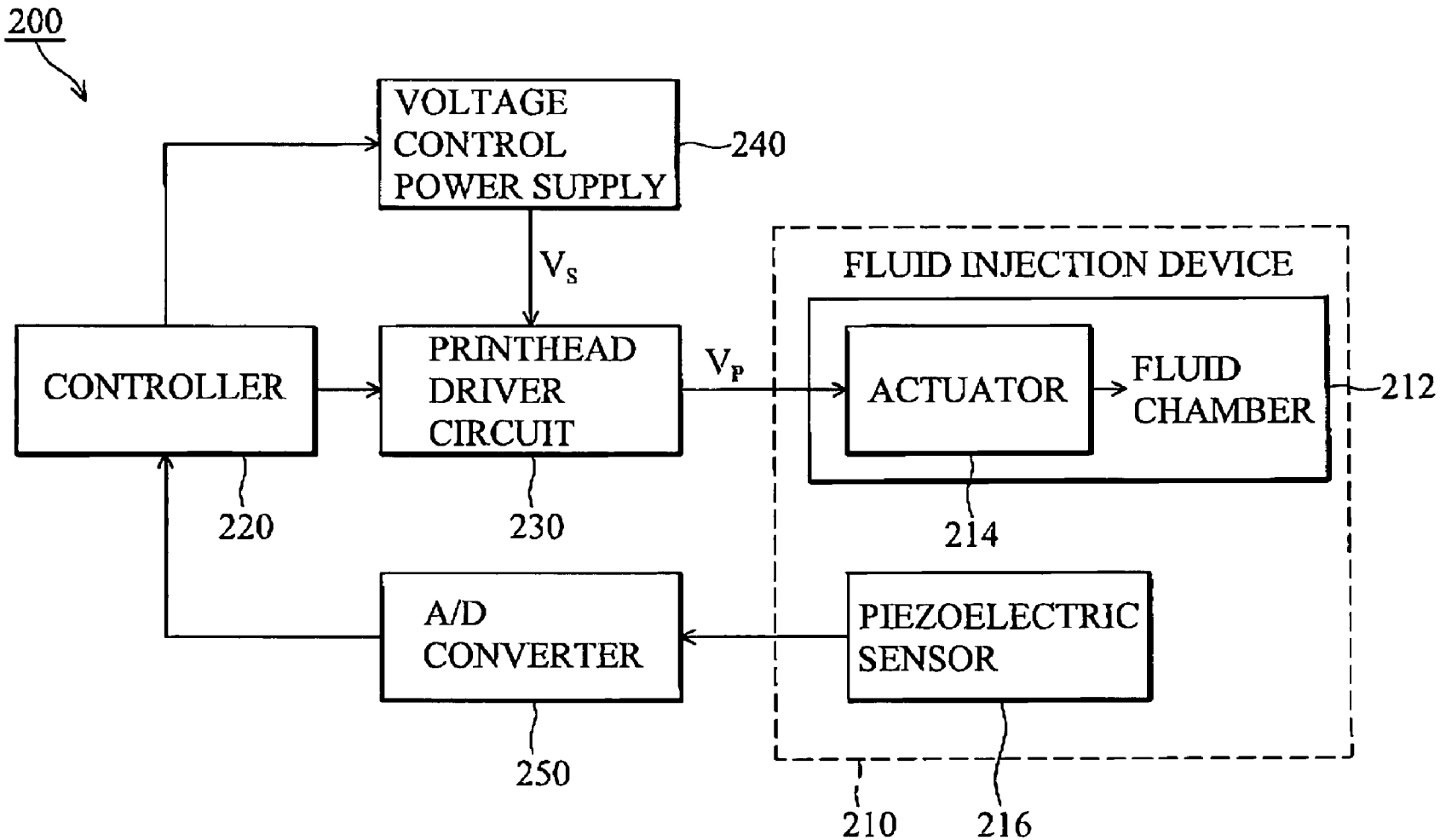
FIG. 12 shows a block diagram of an embodiment of a method for optimizing printing parameters of the invention.

Alternatively, the invention further provides a method for analyzing the amount of fluid in a fluid chamber of the fluid injector chip. FIG. 12 is a block diagram of an embodiment of a method for optimizing printing parameters of the invention. After a controller 220 receives and processes printing data, operating signals are transmitted to a printhead driver circuit 230. A voltage control power supply 240 provides a control voltage $V_S$ to the printhead driver circuit 230. The magnitude of the control voltage $V_S$ is controlled by the voltage control power supply 240. The printhead driver circuit 230 controlled by the controller 220 provides a driving voltage pulse $V_P$ to actuators 214 of the fluid injection device 210, thereby triggering inkjet injection.

Subsequently, a piezoelectric sensor 216 is provided overlying some fluid chambers 212 of the fluid injection device 210 to measure resonance of the structural layer. An analog signal is transmitted to an analog/digital (A/D) converter 250 to transform a digital output to the controller 220, thereby optimizing printing parameters for the fluid injection device.

The fluid injection device integrating piezoelectric sensors overlying fluid chambers of the invention is advantageous in that the amount of fluid in fluid chambers are measured in situ to prevent dry firing effect. Since the piezoelectric sensor measure longitudinal wave on the structural layer, both thermal bubble driven and piezoelectric diaphragm driven printing are applicable to the invention.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fluid injection device integrating a piezoelectric sensor, comprising:

a fluid injector comprising:

a plurality of fluid chambers formed in a substrate for receiving fluid;

a structural layer disposed on the substrate and the plurality of fluid chambers;

at least one fluid actuator disposed on the structural layer opposing each fluid chamber; and a nozzle adjacent to the at least one fluid actuator and connecting each fluid chamber through the structural layer; and a piezoelectric sensor disposed on the structural layer to measure an amount of a fluid content fluid content in each fluid chamber.

2. The fluid injection device as claimed in claim 1, wherein the fluid actuator comprises a thermal bubble actuator.

3. The fluid injection device as claimed in claim 1, wherein the structural layer comprises a low stress silicon nitride layer.

4. The fluid injection device as claimed in claim 1, wherein the piezoelectric sensor comprises a stack structure with a first electrode, a piezoelectric material, and a second electrode.

5. The fluid injection device as claimed in claim 4, wherein the piezoelectric material comprises ZnO, AlN, $LiNbO_3$, $LiTaO_3$, $PbTiO_3$, $(Ba_xSr_{1-x})TiO_3$, $Pb(Zr_yTi_{1-y})O_3$, or a combination thereof.

6. A fluid injection apparatus, comprising:

a cartridge;

a fluid injector chip with a plurality of fluid injectors disposed on the cartridge, each fluid injector comprising:

a plurality of fluid chambers formed in a substrate connecting the cartridge;

a structural layer disposed on the substrate and the plurality of fluid chambers;

at least one fluid actuator disposed on the structural layer opposing each fluid chamber; and a nozzle adjacent to the at least one fluid actuator and connecting each fluid chamber through the structural layer; and at least one piezoelectric sensor disposed on the structural layer to measure an amount of a fluid content in each fluid chamber.

7. The fluid injection apparatus as claimed in claim 6, wherein the fluid actuator comprises a thermal bubble actuator.

8. The fluid injection apparatus as claimed in claim 6, wherein the structural layer comprises a low stress silicon nitride layer.

9. The fluid injection apparatus as claimed in claim 6, wherein the piezoelectric sensor comprises a stack structure with a first electrode, a piezoelectric material, and a second electrode.

10. The fluid injection apparatus as claimed in claim 9, wherein the piezoelectric material comprises ZnO, AlN, $LiNbO_3$, $LiTaO_3$, $PbTiO_3$, $(Ba_xSr_{1-x})TiO_3$, $Pb(Zr_yTi_{1-y})O_3$, or a combination thereof.

11. The fluid injection apparatus as claimed in claim 6, wherein a fluid from the cartridge fills each fluid chamber through a manifold, wherein each fluid chamber is different distance from the manifold.

12. The fluid injection apparatus as claimed in claim 11, wherein the at least one piezoelectric sensor is disposed on a fluid chamber nearest the manifold.

13. The fluid injection apparatus as claimed in claim 11, wherein the at least one piezoelectric sensor is disposed on a fluid chamber farthest from the manifold.

14. The fluid injection apparatus as claimed in claim 11, further comprising a dummy fluid sensing element with a dummy fluid chamber connecting the manifold, wherein the distance from the dummy fluid chamber to the manifold equals or exceeds the distance from the manifold to the farthest fluid chamber.

15. The fluid injection apparatus as claimed in claim 14, wherein the dummy fluid sensing element comprises a comparison piezoelectric sensor on the dummy fluid chamber.

16. The fluid injection apparatus as claimed in claim 11, further comprising a dummy fluid sensing element with a dummy fluid chamber isolated from the manifold, wherein the distance from the dummy fluid chamber to the manifold equals or exceeds the distance from the manifold to the farthest fluid chamber.

17. The fluid injection apparatus as claimed in claim 16, wherein the dummy fluid sensing element comprises a comparison piezoelectric sensor on the dummy fluid chamber.

18. The fluid injection apparatus as claimed in claim 6, further comprising:

an analog/digital converter connecting the at least one piezoelectric sensor, whereby an analog signal of a resonant frequency measured by the at least one piezoelectric sensor is transformed into a digital signal;

a controller comparing the digital signal to a resonant frequency of an empty fluid chamber and optimizing printing parameters accordingly.

19. A method for measuring an amount of a fluid content in a fluid injection device, the fluid injection device having a fluid chamber with a structural layer thereon and at least one actuator disposed on the structural layer, the method comprising the steps of:

measuring a resonant frequency of the structural layer with a piezoelectric sensor, thereby outputting a signal; and receiving the signal and optimizing printing parameters accordingly.

20. The method as claimed in claim 19, wherein the piezoelectric sensor comprises a stack structure with a first electrode, a piezoelectric material, and a second electrode.

* * * * *